US007263163B2

(12) United States Patent
Nazmov et al.

(10) Patent No.: US 7,263,163 B2
(45) Date of Patent: Aug. 28, 2007

(54) X-RAY LENS

(75) Inventors: Vladimir Nazmov, Linkenheim (DE); Elena Reznikova, Linkenheim (DE); Jürgen Mohr, Sulzfeld (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 11/294,878

(22) Filed: Dec. 6, 2005

(65) Prior Publication Data

US 2006/0126342 A1 Jun. 15, 2006

(51) Int. Cl.
*G21K 1/06* (2006.01)

(52) U.S. Cl. ..... 378/84; 378/85; 378/145; 359/718

(58) Field of Classification Search ..... 378/84, 378/85, 145; 359/619, 628, 642, 708–719
See application file for complete search history.

(56) References Cited

U.S. PATENT DOCUMENTS 6,668,040 B2 * 12/2003 Cederstrom ..... 378/84
6,718,009 B1 * 4/2004 Khounsary ..... 378/84

* cited by examiner

*Primary Examiner*—Jurie Yun
(74) *Attorney, Agent, or Firm*—Klaus J. Bach

(57) ABSTRACT

In an x-ray lens for focusing x-rays over a large energy range wherein the lens comprises a large number of lens elements, the lens elements have a quasi-parabolic profile Y(x) according to the equation $$Y(x)=x^2/2[(r+f(x))]$$

Wherein x represents the parabola axis, l/2r represents the half parameter of the parabola and f(x) represents a function different from zero.

8 Claims, 5 Drawing Sheets

X-RAY LENS

BACKGROUND OF THE INVENTION

The invention resides in an x-ray lens for the focusing of x-rays.

x-ray lenses for focusing x-rays consist generally of a large number N of individual focusing elements which are called lens elements.

A. Snigirev, B. Kohn, I. Snigireva, A. Souvorov and B. lengeler, Focusing High-Energy X-rays by compound refractive lenses, Applied Optics, vol. 37, 1998, pages 653-662, discloses lens elements which have a parabolic profile that can be defined by the equation $$Y(x)-x^2/2r. \tag{1}$$

Herein, x designates the parabola axis and ½r is the semi-parameter of the parabola (see for example, Bronstein, Semendjajew, Taschenbuch der Mathematik, 20$^{th}$ edition, 1981, page 278).

Considering the real part δ of the refraction number $n=1+i\beta-\delta$, for this type of x-ray lenses with a wavelength λ, the focal spot size σ is obtained as:

$$\sigma=0.68\sqrt{\lambda\delta(E)F}, \tag{2}$$

wherein F is the focal length of the lens element and E is the photon energy and $\delta(E)\sim E^{-2}$. With wavelengths in the range of the x-ray radiation, that is, about between 0.01 and 1 nm, ideally focal spots of a size σ of less than 0.1 μm can be obtained herewith.

The focal depth FWHM is a measure for the energy range, in which the lens can be considered to be focusing and is defined for lenses with a parabolic profile Y(x) in accordance with the equation (1) by $$FWHM = \sqrt{\left(\frac{\pi\beta}{4\delta}F\right)^2} \tag{3}$$

For known x-ray lenses, this is only a few millimeters which corresponds to an energy range of 0.1% of the nominal energy, that is, a few electron volts (ev).

X-ray spectroscope examinations however require over a wide energy range of the photons, preferably over several keV at a fixed location where particularly the sample to be analyzed is located, a constant size of the focal spot which should be less than 1 μm. For example, with EXAFS examinations the energy ranged ΔE to be covered is about 1 keV; with XANES examinations, it is about 100 eV.

The focal length of a lens with a large focal depth can be defined by the equation:

$$\overline{F(E)}=\overline{(r+f(x))}/2N\delta(E) \tag{4}$$

wherein $\overline{F(E)}$ is the focal length measured from the center of the lens to the center of the focal spot, $\overline{(r+f(x))}$ is the lens curvature radius averaged over the lens aperture and N is the number of the focusing elements of the lens. According to equation 4, the sample is disposed over a focal depth ΔF within the focal spot, when the energy varies by the amount $$\Delta E = \frac{\Delta F}{F}\cdot\frac{E}{2} \tag{5}$$

If for E an average value of 12.7 keV and a typical focal length of 18 cm is selected then a focal depth of ΔF=2.8 cm is obtained for the energy range ΔE of about 1 keV to be covered by the EXAFS examinations.

On the basis of these facts, it is the object of the present invention to provide x-ray lenses which focus the incident x-ray radiation over a large energy range at a fixed location. In particular, an x-ray lens is to be provided which, with a fixed energy, has, over a focal depth of several centimeters, a focal spot with a half value width of less than 1 μm, wherein the limits of the focal depth area determined by those areas where the half value width of the focal spot is greater than 1 μm.

SUMMARY OF THE INVENTION

In an x-ray lens for focusing x-rays over a large energy range wherein the lens comprises a large number of lens elements, the lens elements have a quasi-parabolic profile Y(x) according to the equation $$Y(x)=x^2/2[(r+f(x))], \tag{6}$$

wherein x represents the parabola axis, ½r represents the half parameter of the parabola and f(x) represents a function different from zero.

The equation 6 means that the parabolic profile according to equation 1 is modulated by a function f(x) so that a quasi-parabolic profile is present.

Preferably, the function f(x) is a periodic function which ensures that no local radiation maxima are formed in adjacent areas besides the desired focal spot.

In a preferred embodiment, the quasi-parabolic profile is characterized in that the function f(x) decreases monotonously over one parabola section and increases monotonously over the adjacent next parabola sections etc. A parabola section is a section of Y(x) for a delimited value range of x, for example between $x_o$ and $x_0+l/2$ wherein l/2 is the length of the parabola section.

In a preferred embodiment, the lengths l/2 of these parabola sections are approximately the same. With the selection of the value for the length of the parabola section l/2, the homogeneity of the intensity distribution in the focal length is determined. In order to achieve a good homogeneity, this value should be between 0.1 μm and 5 μm.

In a preferred embodiment, a saw-tooth function is selected for f(x). This function is generally characterized by the relationship $$f(x)=a\,x/l \text{ for } x_n<x<l/2+x_n \text{ and} \tag{7a}$$

$$f(x)=-ax/l \text{ for } ½+x_n<x<l+x_{n1} \tag{7b}$$

wherein the parameter a, which designates the amplitude of the saw-tooth function serves for setting the focal depth n indicates the number of the parabolic section taken into consideration. Alternatively, the saw-tooth function f(x) can be represented by a series development as follows:

$$f(x) = a\sum_{k=0}^{\infty}(-l)^k\sin\left[(2k+1)\pi\frac{x}{l}\right]\cdot g(x)\Big/\left[(2k+1)\frac{\pi}{l}\right]^2 \tag{8}$$

In a further embodiment, the profile of the sawtooth function is modified by a function g(x) in such a way that the function $$f(x) = a\sum_{k=0}^{\infty}(-l)^k \sin\left[(2k+1)\pi\frac{x}{l}\right]\cdot g(x)\Big/\left[(2k+1)\frac{\pi}{l}\right]^2 \quad (9)$$

is formed wherein a is the amplitude of the function and g(x)=1. With this correction, the intensity of the focal spot can be homogenized.

In order to obtain x-ray lenses according to the invention which over a focal depth of several centimeters have a focal spot with a half value width of less than 1 μm, the parameter a, by which the focal depth is adjusted, should be larger than 1 μm and smaller than 40 μm.

In an alternative embodiment, as saw-tooth function, the function $$f(x) = a\sum_{k=0}^{\infty}\left[\sin\left(k\frac{x}{l}\right) + \alpha\sin\left(k\frac{x}{l}+\varphi\right)\right]\Big/\left(\frac{k}{l}\right)^{2+b} \quad (10)$$

is selected. In this way, a very homogenous intensity distribution over the whole focal depth is obtained. The parameters in the equation 10 preferably assume the following values: amplitude a between 1 μm and 25 μm, b between 0 and 3, α between 0 and 0.1 and φ between 0 and π/2.

X-ray lenses according to the invention exhibit—in contrast to conventional x-ray lenses with parabolic profile—a noticeably increased focal depth. The focal spot width is constant over a certain focal depth and therefore permits x-ray spectroscopic examinations within a wide energy range, that is over several KeV without the exposed area changing its form or size, that is, the spectroscopic information comes for all energies within the energy range from the same sample volume.

Below embodiments of the invention will be described with reference to the accompanying drawings.

BRIEF DESCRIPTION OF THE DRAWINGS

As shown in FIG. 4, an x-ray lens 10 for focusing an x-ray beam 2 from an x-ray generator 1 passes through a diaphragm 3 and through a large number of lens elements 11, 11' having a parabolic shape 12, 12' by which the x-ray beam 2' leaving the lens 10 is directed onto a target 4.

DESCRIPTION OF THE EXEMPLARY EMBODIMENTS

The experimental examinations were performed with an energy of E=15 keV at the European Synchrotron Radiation Facility (ESRF). For the computations, the program MATHCAD® was used.

For the FIGS. 1*a-d*, the linear, that is, non-periodic function f(x)=ax was used for modeling the parabolic lens profile. As parameters of the x-ray lens in the FIGS. 1*a-c*, the following values were selected: r=55 μm; a=0.0417r; energy of the x-radiation E=12.7 keV; lens aperture A=150 μm, and number of lens elements N=153.

Figure 1A:
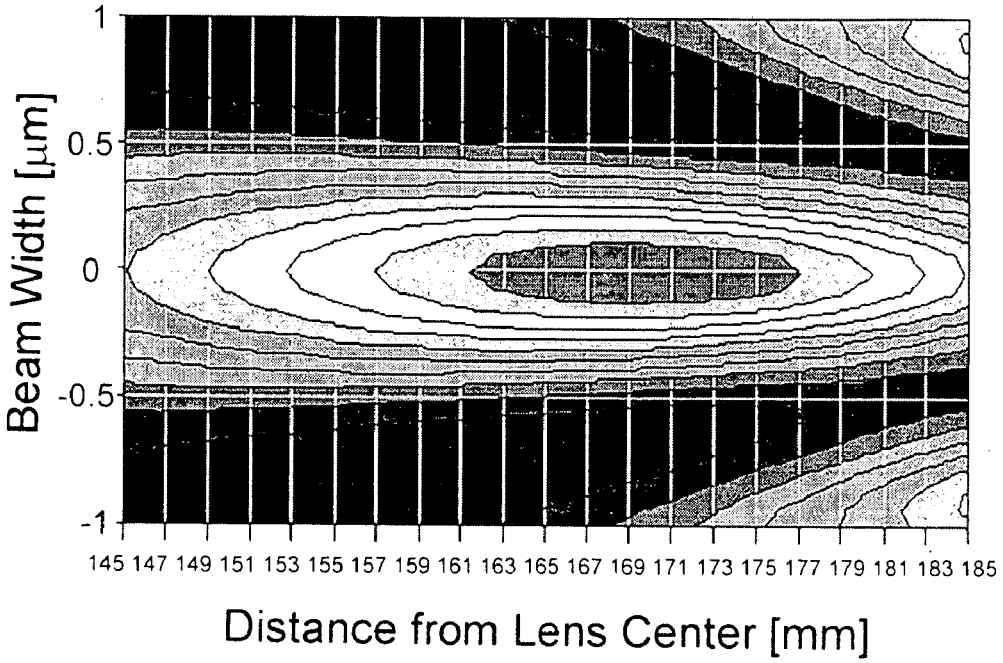
FIG. 1*a* shows the intensity distribution in the area of the focal spot.
Figure 1B:
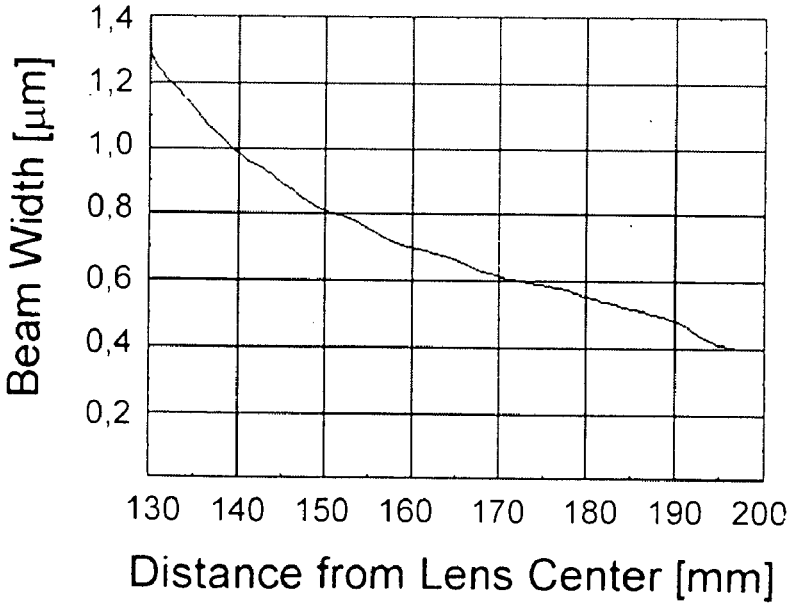
FIG. 1*b* shows the half value width over the focal spot area.
Figure 1C:
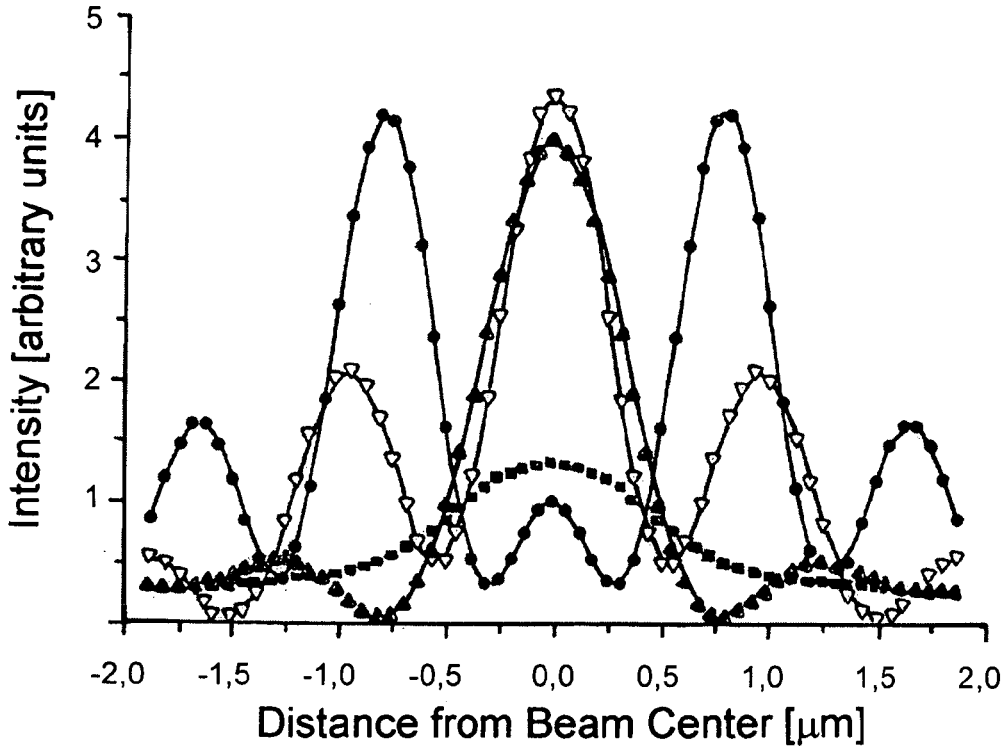
FIG. 1*c* shows the intensity distribution over the width of the focal spot.

FIG. 1*a* shows the intensity distribution in the area of the focal spot. FIG. 1*b* shows the half value width over the focal area and FIG. 1*c* shows the intensity distribution over the width of the focal spot at different locations in the focal area.

Figure 1D:
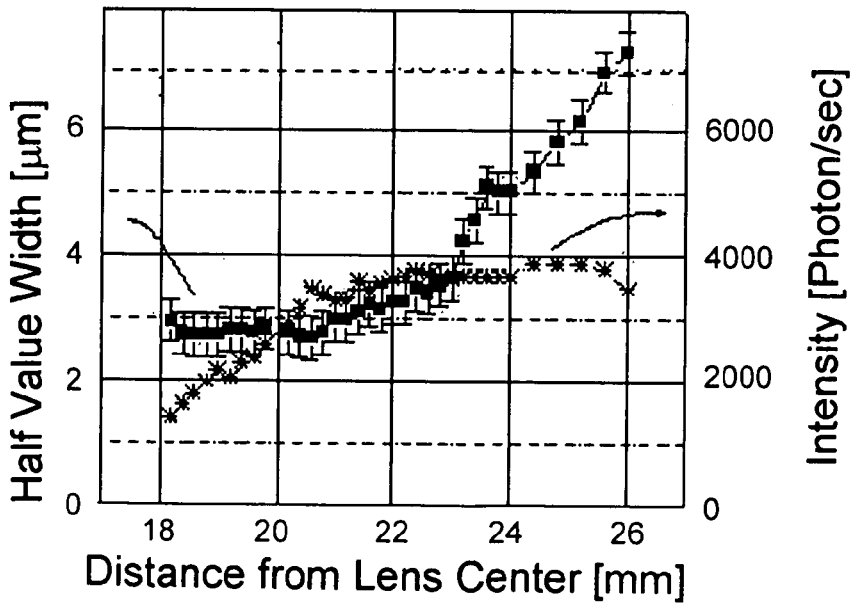
FIG. 1*d* shows the experimentally determined focal depth.

FIG. 1*d* shows the experimentally determined focal depth [■] and intensity [*] of an x-ray lens according to the invention with a non-periodic linear function f(x)=ax. For the examination, a lens with the parameters r=65 μm, a=0.0267r, lens aperture A=150 μm, and the number of lens elements N=153 was used. The area of constant focal spot size with acceptable intensity variations with a half value width of about 3 μm extends between 18.2 cm and 21.7 cm, that is over a focal depth of about 3.5 cm.

Figure 2A:
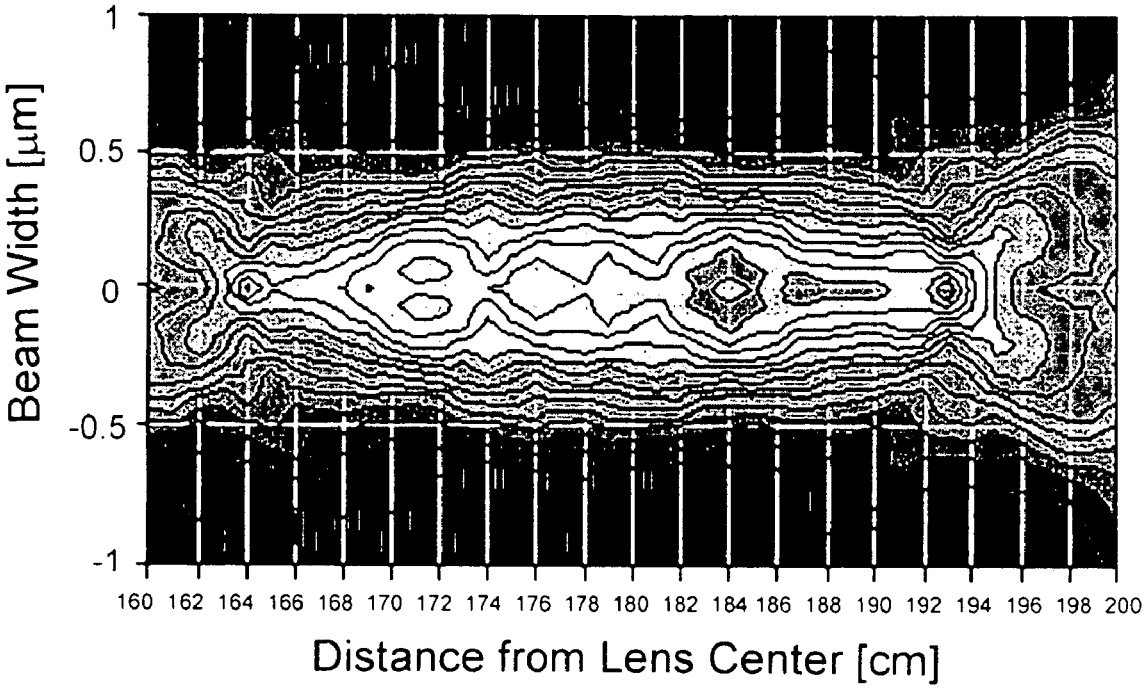
FIG. 2*a* and FIG. 2*b* show the beam width and, respectively, the half value width over the distance from the center of the lens.
Figure 2B:
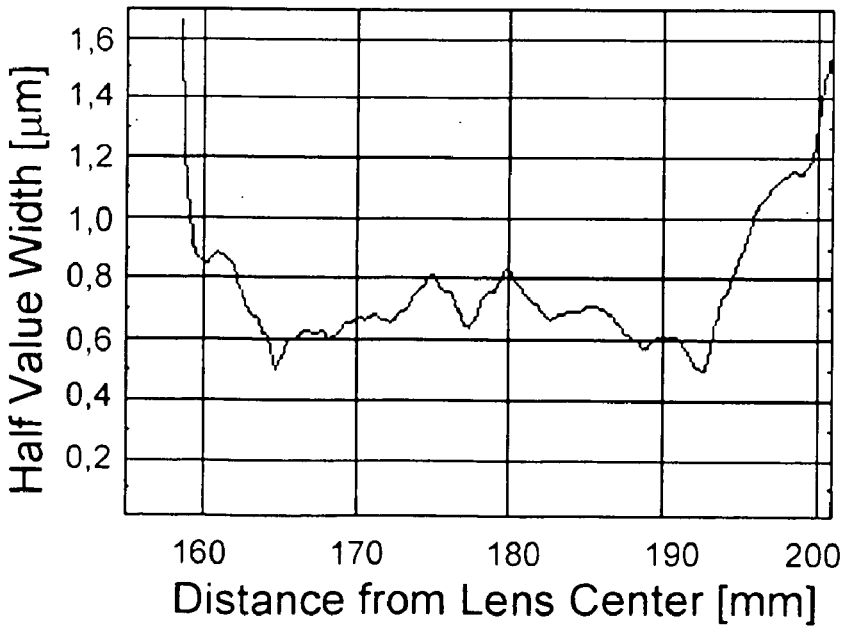

In the FIGS. 2*a-b* for the modeling of the parabolic lens profile, a modified saw-tooth function according to equation 9 was used which had the following parameters; r=91.75 μm, a=0.08278r, E=12.7 keV; A=150 μm, N=153, l=5 μm.

FIG. 2*a* shows the corresponding intensity distribution in the area of the focal spot. FIG. 2*b* shows the half value width over the focal area and the adjacent areas for a function according to the equation 8. From FIG. 2*b*, it is apparent that the x-ray lens has, over a focal depth of 3.7 cm, a focal spot with a half value width of less than 1 μm. Within a focal depth of 1 cm, the half value width varies only by 0.2 μm.

Figure 3A:
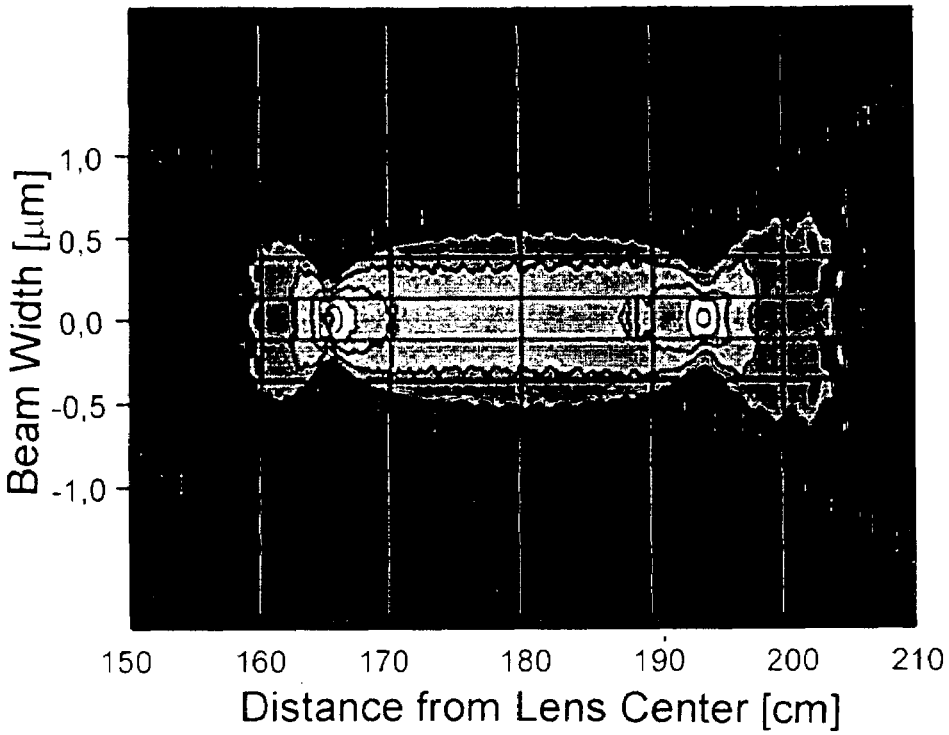
FIG. 3*a* and FIG. 3*b* show the intensity distribution in the focal spot and, respectively, the half value width over the focal width.
Figure 3B:
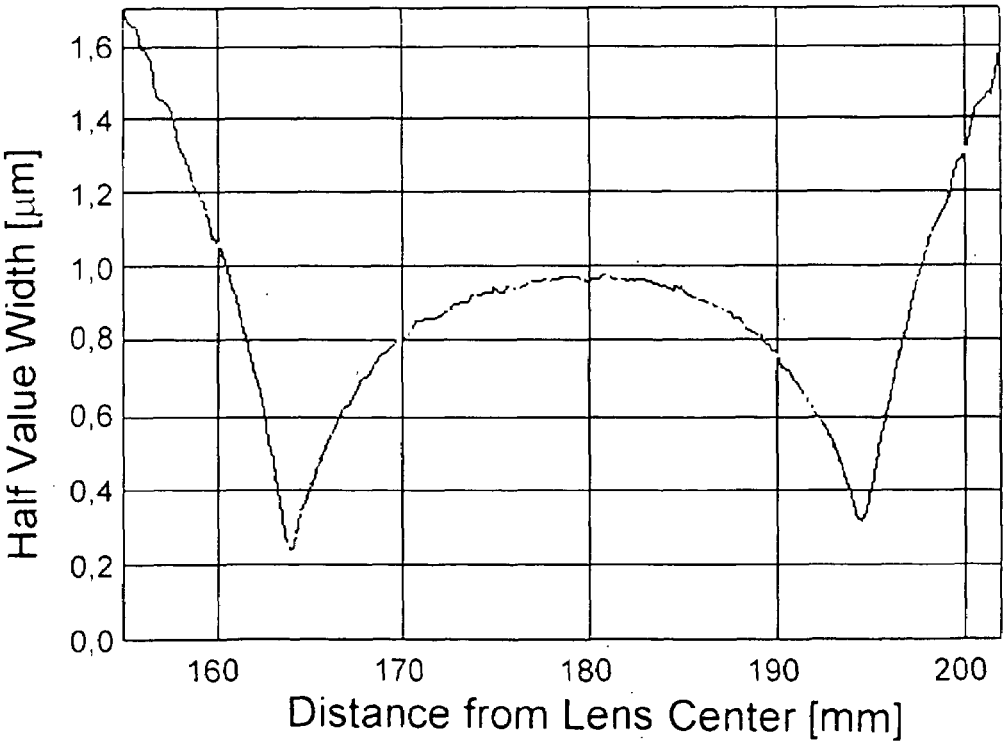
Figure 4:
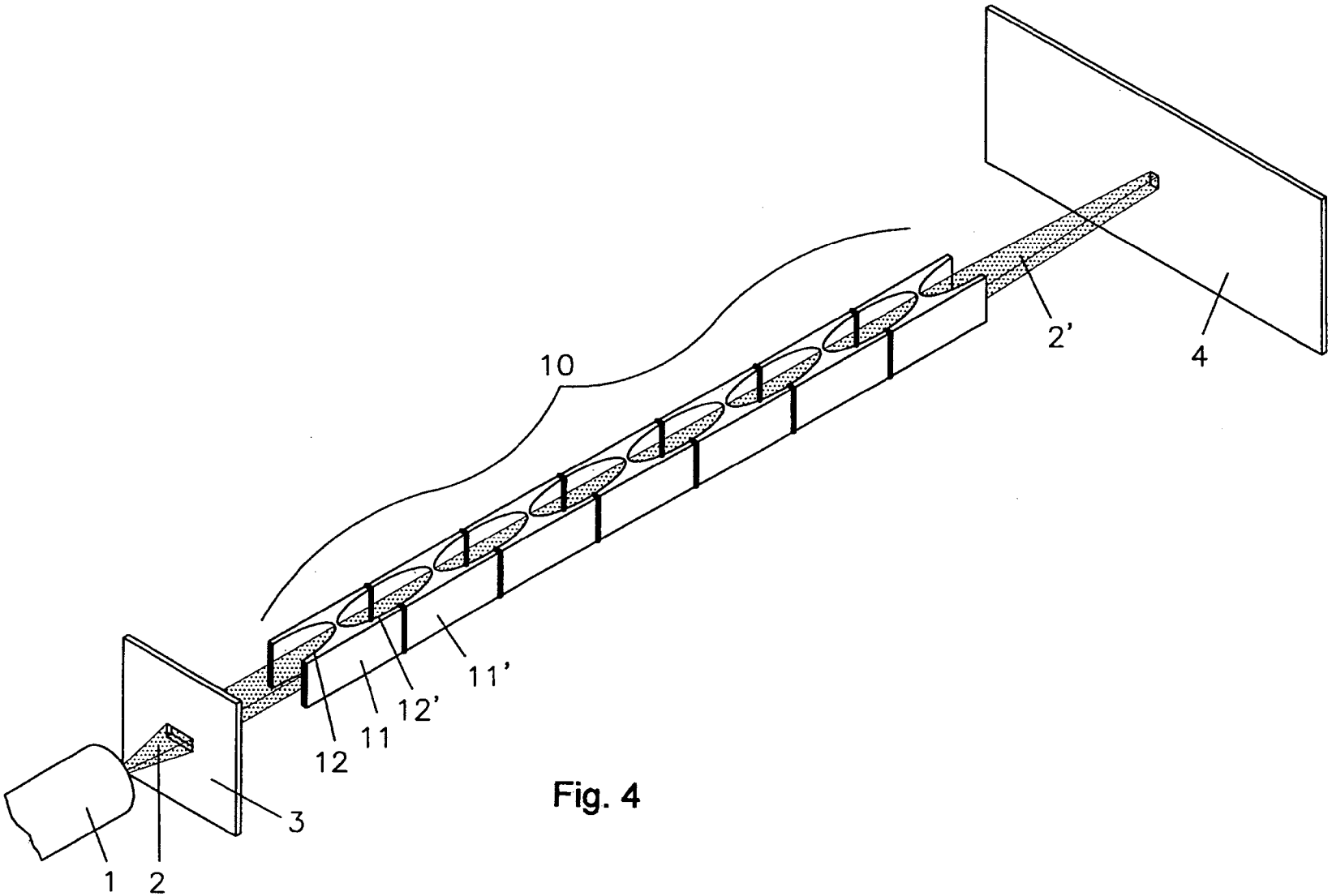
FIG. 4 shows an x-ray lens for focusing x-rays over a large energy range.

In FIGS. 3*a*-3*b* for the modeling of the parabolic lens profile, a function according to equation 9 was selected with the following parameters: r=100 μm, a=0.08575r; t=1.3 μm; E=12.2 keV; N=153.

FIG. 3*a* shows the intensity distribution in the area of the focal spot. FIG. 3*b* shows the half value width over the focal area and the adjacent areas for a function according to equation 9. From FIG. 3*b*, it is apparent that this x-ray lens has over a focal depth of 3.7 cm a focal spot with a half value width of less than 1 μm. Within a focal depth of 1 cm, the half value width varies less than 0.05 μm.

What is claimed is:

1. An x-ray lens for focusing x-rays, comprising a multitude of lens elements (11, 11') of which each has a modulated parabolic profile F(x) according to the equation $$F(x)=x^2/2[(r+f(x))]$$

wherein x represents the parabola axis, ½ r the half parameter of the parabola and f(x) a function different from zero.

2. An x-ray lens according to claim 1, wherein the function f(x) is a periodic function which has a monotonously decreasing value over a parabola section (11) and a monotonously increasing value over an adjacent parabola section (11').

3. An x-ray lens according to claim 2, wherein the parabola sections (11, 11') have essentially the same length.

4. An x-ray lens according to claim 2, wherein the function f(x) is a saw-tooth function.

5. An x-ray lens according to claim 4, wherein f(x) is a modified saw-tooth function according to $$f(x) = a\sum_{k=0}^{\infty}(-l)^k \sin\left[(2k+1)\pi\frac{x}{l}\right]\cdot g(x)\Big/\left[(2k+1)\frac{\pi}{l}\right]^2$$

wherein a represents the amplitude of the saw-tooth function, l/2 represents the length of the parabola section and g(x)≈1 is a profile correction.

6. An x-ray lens according to claim 5, wherein the amplitude a has a value between 1 μm and 40 μm and the length l is between 0.1 μm and 5 μm.

7. An x-ray lens according to claim 4, wherein f(x) is a modified saw-tooth function according to:

$$f(x) = a\sum_{k=0}^{\infty}\left[\sin\left(k\frac{x}{l}\right) + \alpha\sin\left(k\frac{x}{l} + \varphi\right)\right] \Big/ \left(\frac{k}{l}\right)^{2+b}$$

wherein b, α and ϕ designate parameters of the function.

8. An x-ray lens according to claim 7, wherein a represents the amplitude of the saw-toothe function, wherein the amplitude a has a value of between 1 μm and 25 μm, the length of l has a value of between 0.1 μm and 5 μm, the parameter b has a value of between 0 and 3, α has a value between 0 and 0.1 and ϕ has a value between 0 and π/2.

* * * * *